United States Patent [19]

Barnhouse

[11] Patent Number: 4,877,041

[45] Date of Patent: Oct. 31, 1989

[54] CIGARETTE SUBSTITUTE FOR SMOKING CESSATION

[76] Inventor: Robert L. Barnhouse, 113 Almeria St., Royal Palm Beach, Fla. 33411

[21] Appl. No.: 230,003

[22] Filed: Aug. 8, 1988

[51] Int. Cl.[4] ..... A24F 47/00

[52] U.S. Cl. ..... 131/270; 131/329

[58] Field of Search ..... 131/270, 329

[56] References Cited

U.S. PATENT DOCUMENTS 3,886,953 6/1975 Pope ..... 131/270

*Primary Examiner*—V. Millin

[57] ABSTRACT

A cigarette substitute, for smoking cessation, comprises a card on one surface of which are formed one or more areas having an abrasive encapsulated aroma thereon. Abrasion, as by rubbing or scratching releases a tobacco smoke aroma. A combined menthol/tobacco smoke aroma can also be provided. Identification can be printed on one surface, usually not the surface having the aroma areas. Instructions for use and health advisory printing can be provided on the surface having the aroma areas. The card-like members preferably have dimensions such that a particular number have the same overall dimensions as a package of cigarettes.

14 Claims, 2 Drawing Sheets

CIGARETTE SUBSTITUTE FOR SMOKING CESSATION

This invention relates to a cigarette substitute for assisting in smoking cessation, and in particular is concerned with a substitute which simulates cigarette characteristics.

For health and other reasons, large numbers of cigarette smokers are trying to stop smoking. However it is very difficult for many smokers to stop smoking and various ways of providing assistance, and support, exist. These range from imitation cigarettes, candy and other materials which help to assuage the desire for smoking, or can make smoking unpleasant in taste, to psychological and other treatments and training. Some of these are expensive, others not particularly effective.

The present invention provides a substitute which simulates cigarette characteristics and also conveys supportive messages.

Broadly the invention provides a cigarette substitute which comprises a card-like member having on one surface at least one abrasable encapsulated aroma area. The size, and thickness, of card-like members can be such that a predetermined number, for example 20 or 25, will be of the same size as an equivalent package of cigarettes. In addition to the aroma area, or areas, usage instructions, product identification and other printing can be provided on each member. In use, by abrading an aroma area, the aroma of tobacco smoke can be produced. It is also possible to provide for an aroma corresponding to a menthol cigarette and with two aroma areas one can be for normal tobacco smoke aroma and the other for menthol/tobacco smoke aromas.

In accordance with the invention, a cigarette substitute comprises a flat, card-like member having at least one abrasable encapsulated cigarette smoke aroma area on one surface. The invention further comprises a plurality of card-like members each having at least one abrasable encapsulated cigarette smoke aroma area on one surface, the size and thickness of the card-like members being such that a pack having a predetermined number will have the same, or similar, overall dimensions as a package of cigarettes.

The invention will be readily understood by the following description of an embodiment, by way of example, in conjunction with the accompanying drawings, in which.

Figure 1:
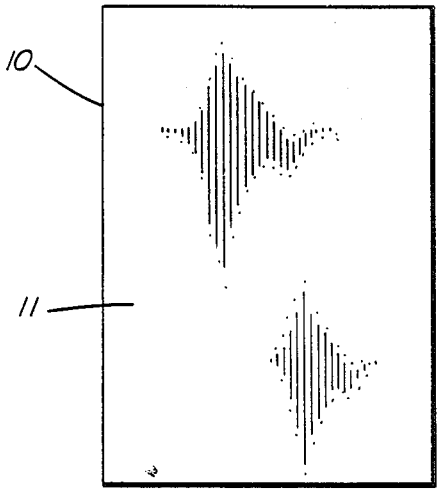
FIG. 1 is a plan view on one surface of a card-like member.
Figure 2:
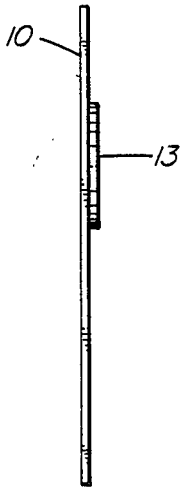
FIG. 2 is a side view of the card-like member in FIG. 1.
Figure 3:
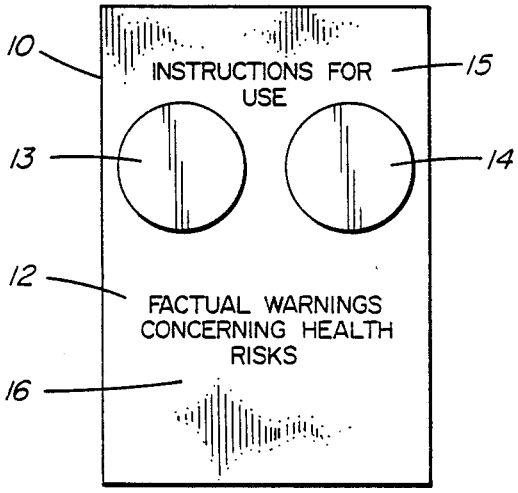
FIG. 3 is a plan view of the other surface of the card-like member in FIG. 1.

As illustrated in FIGS. 1, 2 and 3, a card-like member 10, hereafter referred to as a card for convenience, has one surface 11, for example the front surface, on which can be printed a brand name, type or other information. On the other surface 12, the back surface, there are formed, in the example, two areas 13 and 14 which are formed by depositing an ink containing encapsulated aromas. For example area 13 can contain encapsulated tobacco smoke aroma while area 14 can contain encapsulated menthol/tobacco smoke aroma. The aromas can be released as by rubbing with a thumb or finger, or by scratching with a thumb or finger nail.

In addition to the aroma areas 13 and 14, other information, such as factual warnings concerning health risks and instructions for use can be printed on the surface 12, in areas 15 and 16.

Only one aroma area need by provided, and of course, more than two. The actual shape of the areas can vary from that shown. For example, they can be square, elongate, or strips extending across the surface, The ink is readily applied by normal printing methods, or by screening.

One example of an ink containing aromas is manufactured by Djinnii Industries, Inc., of Dayton, Ohio, under the Trade Mark "instascent". This is a water-based ink, in which the aroma material is micro-encapsulated. The aromas are released by scratching with a finger nail.

Figure 4:
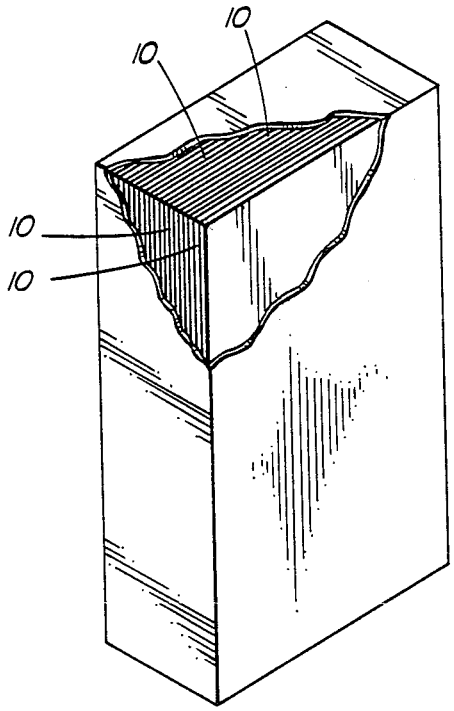
FIG. 4 is a perspective view of a package of the card-like members of FIGS. 1, 2 and 3.

The dimensions of a card are such that a number of them stacked together, will have the same, or similar, dimensions as a pack of cigarettes. As an example, twenty of the cards will have an overall thickness equal to that of a pack of cigarettes, while the width and length of the cards is the same as the width and length of a pack of cigarettes. The thickness over the aroma areas will of course be slightly more than the card thickness itself, but not necessarily as much thicker as represented in FIG. 2, in which thicknesses are exaggerated slightly for clarity. An example of a pack of cards is illustrated in FIG. 4. A particular example of packaging is in a so-called snap-lid box, for example of clear plastic.

In use, if a person has a pack of the cards, one is removed and the desired aroma area, if more than one, scratched and the card placed close to the nose.

A package of cards is relatively inexpensive, is a placebo for cigarettes, and is easy to use. Reasons for cessation of smoking imprinted on the card give a psychological boost to the decision to stop smoking.

A typical material for the cards is a thin stiff cardboard, although thin relatively rigid plastic can be used. The cards can be manufactured singly or in longer sheets which are afterward cut. Conveniently one sheet can comprise the cards for one package.

What is claimed is:

1. A cigarette substitute for smoking cessation comprising: a flat card-like member having at least one abrasable encapsulated smoke aroma area on one surface, including directions for use printing and health advisory printing on said one surface.

2. A cigarette substitute as claimed in claim 1, having two abrasable encapsulated cigarette smoke aroma areas on said one surface.

3. A cigarette substitute as claimed as claim 2, one of said aroma areas having an encapsulated menthol/-tobacco smoke aroma.

4. A cigarette substitute as claimed in claim 1, including product identification printing on one surface.

5. A cigarette substitute as claimed in claim 1, including product identification printing on the other surface.

6. A cigarette substitute as claimed in claim 1, said card-like member being of thin stiff cardboard.

7. A cigarette substitute comprising a package having a plurality of card-like members, each card-like member having at least one abrasable encapsulated cigarette smoke aroma are on one surface, and including directions for use printing and health advisory printing on said one surface.

8. A cigarette substitute as claimed in claim 7, each card-like member having two abrasable encapsulated cigarette smoke aroma areas on said one surface.

9. A cigarette substitute as claimed in claim 7, one of said aroma areas on each card-like member having an encapsulated menthol/tobacco smoke aroma.

10. A cigarette substitute as claimed in claim 7, including product identification printing on one surface.

11. A cigarette substitute as claimed in claim 7, including product identification printing on the other surface.

12. A cigarette substitute as claimed in claim 7, each card-like member being of thin stiff cardboard.

13. A cigarette substitute as claimed in claim 7, each card-like member having a width and a length corresponding to the width and length of a cigarette package.

14. A cigarette substitute as claimed in claim 13, said plurality of card-like members having a total thickness corresponding to the thickness of a cigarette package.

* * * * *